US008376175B2

(12) United States Patent
Gonzalez

(10) Patent No.: US 8,376,175 B2
(45) Date of Patent: Feb. 19, 2013

(54) CONTAINER TOP HAVING SEALABLE CHAMBER FOR THE STORING AND MIXING OF TWO OR MORE SUBSTANCES

(75) Inventor: Marcos Gonzalez, Davie, FL (US)

(73) Assignee: Global Harvest Group, Inc., Hialeah, FL (US)

( * ) Notice: Subject to any disclaimer, the term of this patent is extended or adjusted under 35 U.S.C. 154(b) by 0 days.

(21) Appl. No.: 13/404,482

(22) Filed: Feb. 24, 2012

(65) Prior Publication Data

US 2012/0152951 A1 Jun. 21, 2012

Related U.S. Application Data

(63) Continuation of application No. 12/812,386, filed as application No. PCT/US2009/000182 on Jan. 12, 2009.

(60) Provisional application No. 61/006,412, filed on Jan. 11, 2008.

(51) Int. Cl.

| | |
|---|---|
| ***B65D 51/18*** | (2006.01) |
| ***B65D 85/00*** | (2006.01) |
| ***B65D 41/00*** | (2006.01) |
| ***B65D 41/34*** | (2006.01) |
| ***B65D 25/08*** | (2006.01) |

(52) U.S. Cl. ..... 220/254.8; 220/254.1; 220/521; 215/329; 215/354; 206/219; 206/221; 53/268

(58) Field of Classification Search ..... 220/254.1, 220/254.8, 521, 522; 215/228, 329, 354, 215/DIG. 8; 206/219, 221; 53/258, 268; 141/65, 67, 126

See application file for complete search history.

(56) References Cited

U.S. PATENT DOCUMENTS

| | | | | |
|---|---|---|---|---|
| 7,740,134 | B2 * | 6/2010 | Sweeney et al. | 206/221 |
| 2007/0074979 | A1 | 4/2007 | Cho | |

FOREIGN PATENT DOCUMENTS

| | | | |
|---|---|---|---|
| JP | 11-208735 | A | 8/1999 |
| JP | 2005/112436 | A | 4/2005 |
| WO | 2005/044683 | A1 | 5/2005 |
| WO | 2005/100190 | A1 | 10/2005 |
| WO | 2007/111463 | A2 | 10/2007 |
| WO | 2007/117070 | A1 | 10/2007 |

* cited by examiner

*Primary Examiner* — Anthony Stashick
*Assistant Examiner* — Madison L Poos
(74) *Attorney, Agent, or Firm* — Nath, Goldberg & Meyer; Jerald L. Meyer

(57) ABSTRACT

A storage cap for use with a container includes a first structure having a first wall at least partially defining an inner storage chamber operable for storing a first substance and defining a first annular opening having a first annular convex surface facing toward the storage chamber. The storage cap includes a second structure coupled to the first structure and has a plunger element located within the storage chamber having a domed-end with a convex surface facing to the annular opening and a radius greater than one-half of the diameter of the first opening. The second structure is moveable to make and break contact with the annular opening. When the domed end is in contact with the first annular convex surface, a seal is formed between two convex surfaces along an annular path.

18 Claims, 11 Drawing Sheets

CONTAINER TOP HAVING SEALABLE CHAMBER FOR THE STORING AND MIXING OF TWO OR MORE SUBSTANCES

This application is a continuation of U.S. patent application Ser. No. 12/812,386 filed May 9, 2011, which is a National Stage Application filed under U.S.C 371 of international patent application number PCT/US2009/000182 with an international filing date of Jan. 12, 2009, and which claims benefit under 35 U.S.C. 119(e) of U.S. provisional application No. 61/006,412 filed Jan. 11, 2008, the entire content of which is hereby incorporated by reference in its entirety.

BACKGROUND

1. Field

This disclosure relates to devices for the storage and mixing of different substances using a portable and inexpensive container.

2. Background

There are a plethora of consumer and medical products on the market that have a very limited shelf life, or otherwise depend on refrigeration to extend shelf life to a tolerably extent. For example, the nutritional value of various vitamin-enriched drinks on the market seriously degrades to a small fraction of the original value (when bottled) before such drinks make it to store shelves. Similarly, various medications that must be dissolved in liquid before being administered degrade very rapidly once introduced into the liquid.

While there have been various bottle/container caps, or containers containing multiple chambers to address these issues, such containers suffer from a number of shortcomings. For example, some caps require the puncturing of a membrane separating the different substances to be combined. As a result, there is a likelihood that a portion of the membrane could break off and consequently be ingested. Other solutions that don't involve piercing a membrane have other flaws, such as questionable seals or production difficulty issues. Thus, new technology directed toward containers that accommodate the storage and mixing of different substances is desirable.

SUMMARY

Various aspects and embodiments of the invention are described in further detail below.

In a first series of embodiments, a storage cap for use with a container includes a first structure having a first wall at least partially defining an inner storage chamber operable for storing a first substance, the first wall also defining a first annular opening having a first annular convex surface facing toward the storage chamber, and a second structure coupled to the first structure, the second structure including plunger element located within the storage chamber having a domed-end with a convex surface facing to the annular opening, the domed-end having a radius greater than one-half of the diameter of the first opening, wherein the second structure is configured such that the domed end is moveable to make and break contact with the annular opening, and wherein when the domed end is in contact with the first annular convex surface, a seal is formed between two convex surfaces along an annular path to seal the storage chamber.

In another series of embodiments a storage cap for use with a container includes a first structure having a first wall at least partially defining an inner storage chamber operable for storing a first substance, the first wall also defining a first annular opening, and second structure coupled to the first structure, the second structure including plunger element located within the storage chamber, wherein the first and second structure together form a means to seal or unseal the storage chamber in response to a twisting action of a grip on the second structure relative to the first structure.

In another series of embodiments, a method for filling a storage cap for use with a container, wherein the storage cap includes a first structure having a first wall at least partially defining an inner storage chamber operable for storing a first substance, the first wall also defining a first annular opening, and a second structure coupled to the first structure, the second structure including plunger element located within the storage chamber having a domed-end with a convex surface facing to the annular opening, and wherein the second structure is configured such that the domed end is moveable to make and break contact with the annular opening via a twisting motion of a grip on the second structure relative to the first structure is disclosed. The method includes placing a first tube having a product-depositing passage, a displaced-air passage and a flange over the annular opening such that the flange substantially seals respective ends of the product-depositing passage and the displaced-air passage to the storage chamber, using the product-depositing passage to deposit a first substance within the storage chamber while the displaced-air passage removes displaced air from the storage chamber, and twisting the first structure relative to the second structure to cause the domed end to form a seal with the annular opening thus sealing the first substance within the storage chamber.

In another series of embodiments, an automated assembly line includes a conveyer line operable to convey a plurality of storage caps for use with a container, wherein each storage cap includes a first structure having a first wall at least partially defining an inner storage chamber operable for storing a first substance, the first wall also defining a first annular opening, and a second structure coupled to the first structure, the second structure including plunger element located within the storage chamber having a domed-end with a convex surface facing to the annular opening, and wherein the second structure is configured such that the domed end is moveable to make and break contact with the annular opening via a twisting motion of a grip on the second structure relative to the first structure, a first station in the conveyer line with a first tube having a product-depositing passage, a displaced-air passage and a flange operable to be placed over the annular opening of each storage cap such that the flange substantially seals respective ends of the product-depositing passage and the displaced-air passage to the respective storage chamber, and wherein the product-depositing passage is then operable to deposit a first substance within the storage chamber while the displaced-air passage is operable to remove displaced air from the storage chamber, and a twisting mechanism on the conveyer belt operable to twist the first structure relative to the second structure to cause the domed end to form a seal with the annular opening thus sealing the first substance within the storage chamber.

BRIEF DESCRIPTION OF THE DRAWINGS

The features and nature of the present disclosure will become more apparent from the detailed description set forth below when taken in conjunction with the accompanying drawings in which reference characters identify corresponding items.

DETAILED DESCRIPTION

The disclosed methods and systems below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

Figure 1:
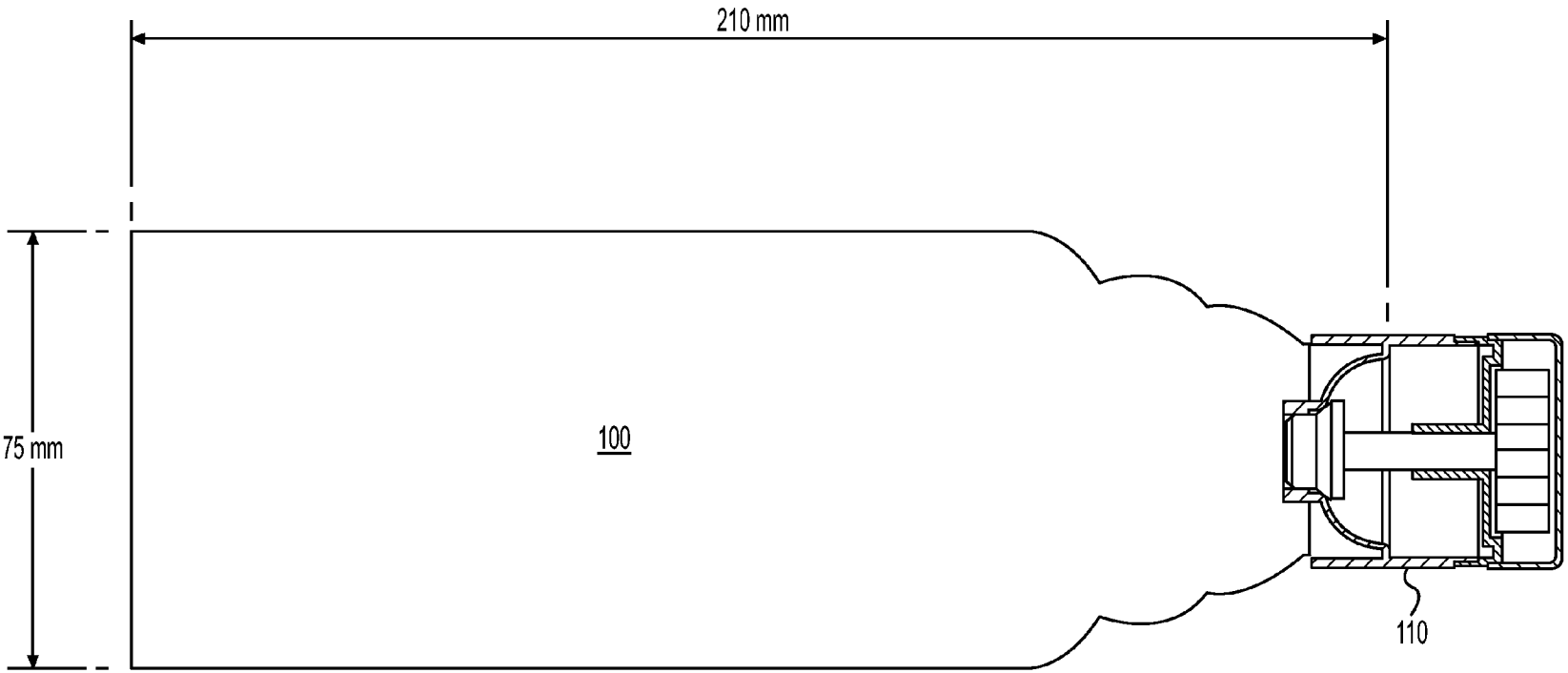
FIG. 1 depicts a container with a first exemplary storage cap.

FIG. 1 depicts a container 100 with a first exemplary storage cap 110. Generally, the container 100 may be filled with a first substance, such as water, while the first exemplary storage cap 110 is configured to be filled with a second substance, such as a powdered drink mix, powdered vitamin mixture, or medication. The container 100 and first exemplary storage cap 110 may be bonded together via any number of means, such as ultrasonic welding or via a screw-top fitting, e.g., the same sort of fitting commonly seen between plastic soda bottles with their caps. One advantage of using storage caps is that the shelf life of various consumable drinks and medications can be extended when the active portions of one substance, e.g., vitamins, is in powdered form as compared to situations where such substances would be dissolved in liquid, which may cause the active substances to degrade.

For the purpose of this disclosure, the term "storage cap" refers to a device configured to be fastened to a container containing a first substance while itself being capable of separately containing a second substance, and sealing/isolating the first substance from the second substance until such time as an operator, e.g., a consumer of a vitamin-enriched drink, chooses to mix the two substances by mechanically disengaging or removing whatever seal separates the two substances.

Figure 2C:
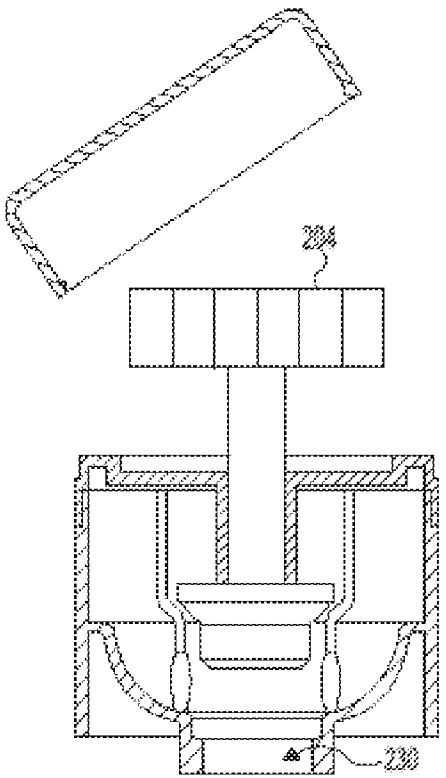
FIGS. 2A-2C depicts details of the first exemplary storage cap of FIG. 1.
Figure 2B:
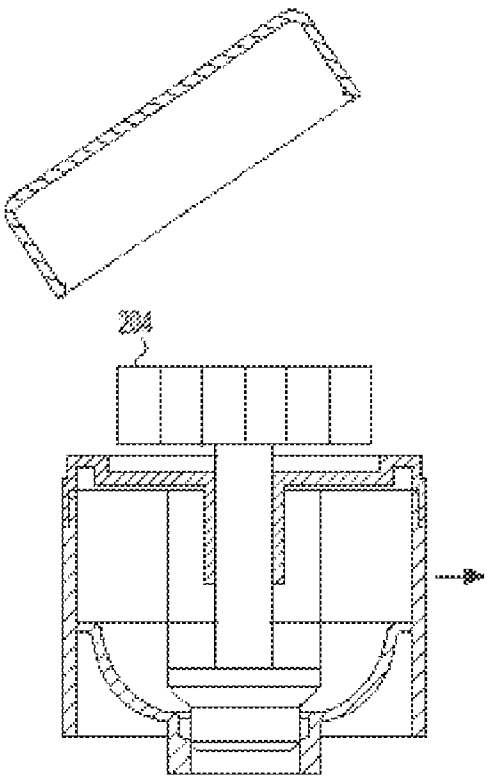
Figure 2A:
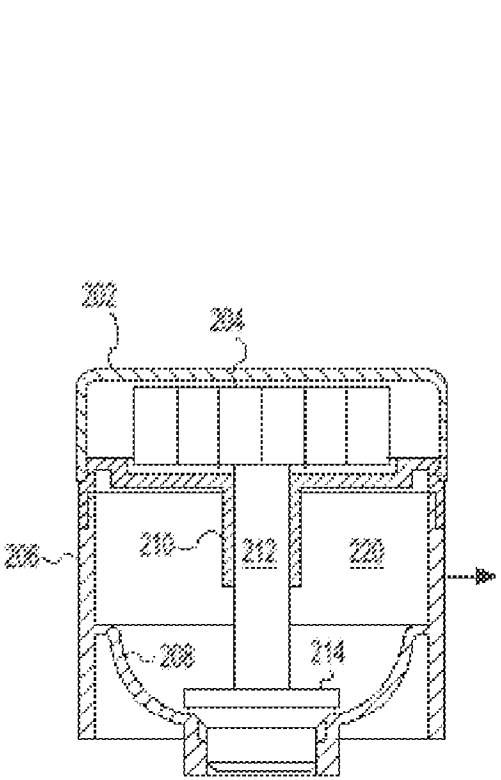

FIGS. 2A-2C depicts details of the first exemplary storage cap 110 of FIG. 1. As shown in FIGS. 2A-2C, the storage cap 110 includes an outer wall 206, a lower wall 208 and an inner sleeve 210 defining an inner storage chamber 220, as well as an annular opening 230 at the bottom. The storage cap 110 further includes a grip 204 connected to a plunger 212, which itself is connected to a stopper 214. A cover 202 may be optionally provided for the grip 204.

In operation, an operator may remove cover 202 to expose grip 204. Afterward, the operator may pull grip 204 to cause the stopper 214 to pull away from the annular opening 230 to break the seal created between the annular opening 230 and the stopper 214.

Figure 3B:
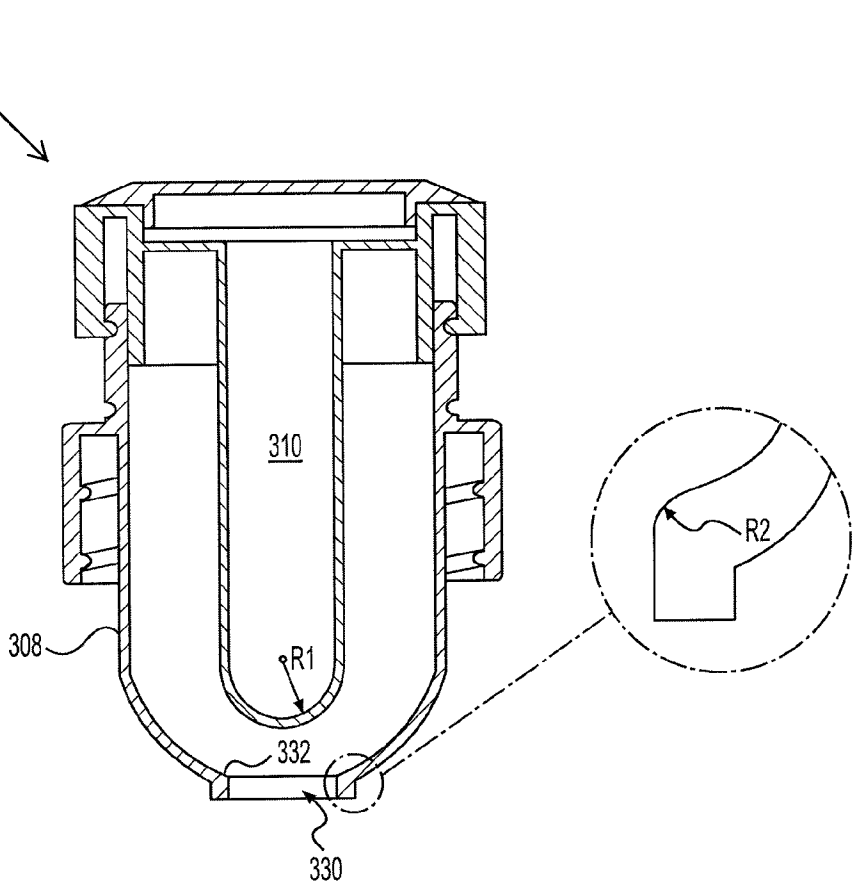
FIGS. 3A and 3B depict details of a second exemplary storage cap.
Figure 3A:
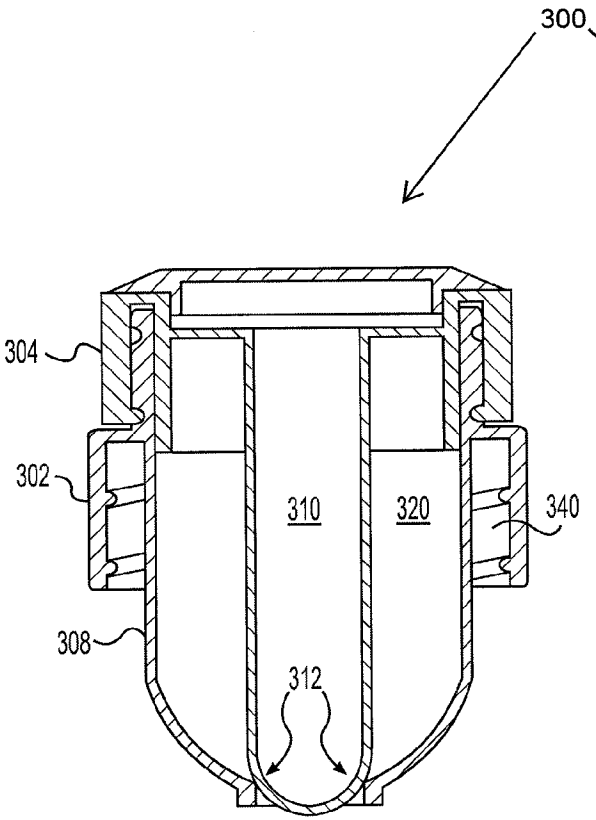

FIGS. 3A and 3B depict details of a second exemplary storage cap 300.

As shown in FIGS. 3A-3B, the second exemplary storage cap 300 includes a first wall 302 and an outer wall 308 that at least partially define an inner storage chamber 320, as well as an annular opening 330 at the bottom. The first wall 302 and outer wall 308 also define a threaded chamber for enabling the storage cap 300 to be fastened to a container, such as a plastic bottle with a threaded neck. Note that exemplary elements 302 and 308 can be made from a single structure that may be inexpensively produced by the injection molding of various low-cost plastics. Also note that opening 330 is annular and has an inner annular-shaped corner 332—essentially a convex surface having radius R2 with the notion that R2 in the example of FIGS. 3A-3B is very small as compared to radius R1 of the domed-end of plunger 310, i.e., $R1 \ll R2$, or $R2 \leqq 10 \cdot R1$. In various other embodiments and as will be shown below, the comparative radii of R1 and R2 may vary greatly in proportion, e.g., $R2/10 \leqq R1 \leqq 10 \cdot R2$, $R2/5 \leqq R1 \leqq 5 \cdot R2$, $R2/3 \leqq R1 \leqq 3 \cdot R2$; $R2/2 \leqq R1 \leqq 2 \cdot R2$, $R2/1.5 \leqq R1 \leqq 1.5 \cdot R2$ and $R1 \approx R2$. s Continuing, the second exemplary storage cap 300 also includes a grip 304 connected to a domed plunger 310 with the domed-end again having a radius R1—noting that in practice R1 may be greater than at least half the length of the diameter of opening 330 to assure that the domed-end can form a seal with opening 330 at edge 332 (contact points 312 of FIG. 3*a*). Note that exemplary elements 304 and 310 also can be made from a single structure (e.g., a single piece of uniform plastic) that may be inexpensively produced by the injection molding of various low-cost plastic materials. Also note that the two singular structures are configured such that the domed-end of plunger 310 is moveable to make and break contact with the annular opening 330, and a seal may be made or broken by twisting grip 304 relative to walls 302 and 308.

Figure 4A:
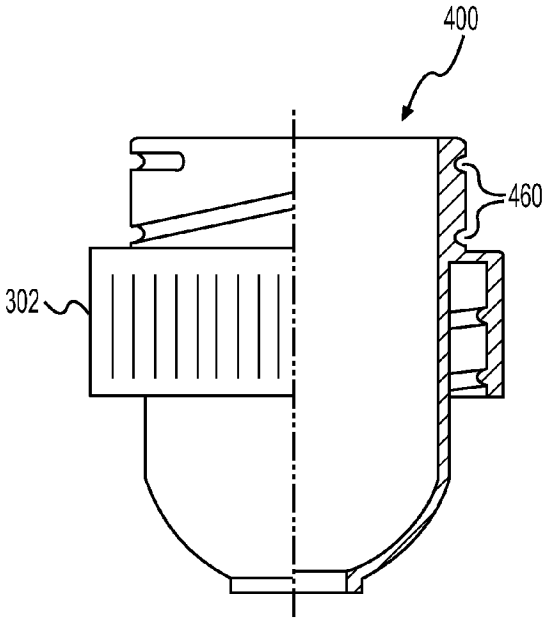
FIGS. 4A-4C depict further details of the second exemplary storage cap.
Figure 4B:
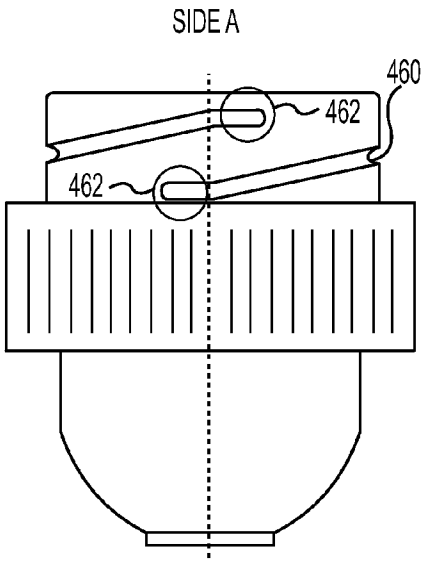
Figure 4C:
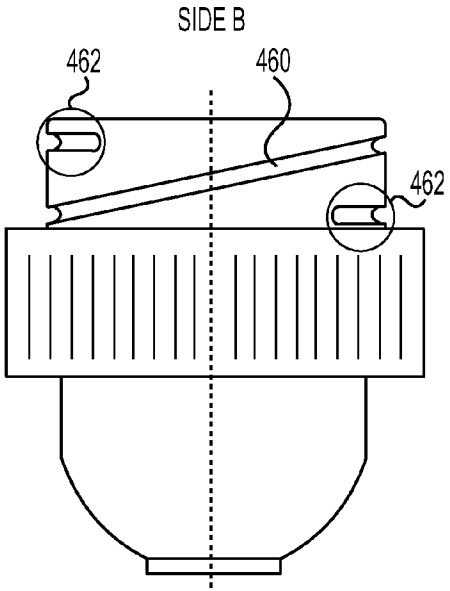
Figure 5A:
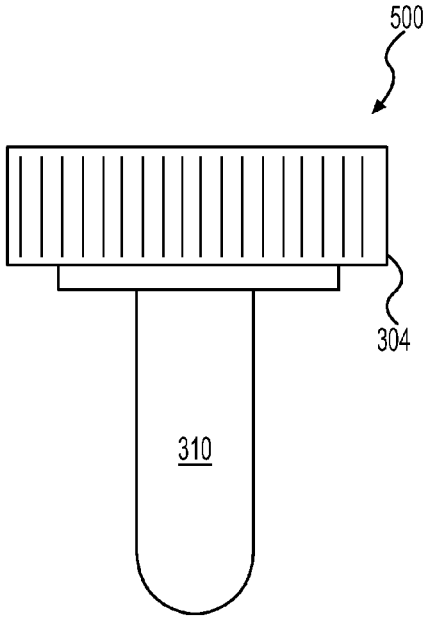
FIGS. 5A-5D depict still further details of the second exemplary storage cap.
Figure 5B:
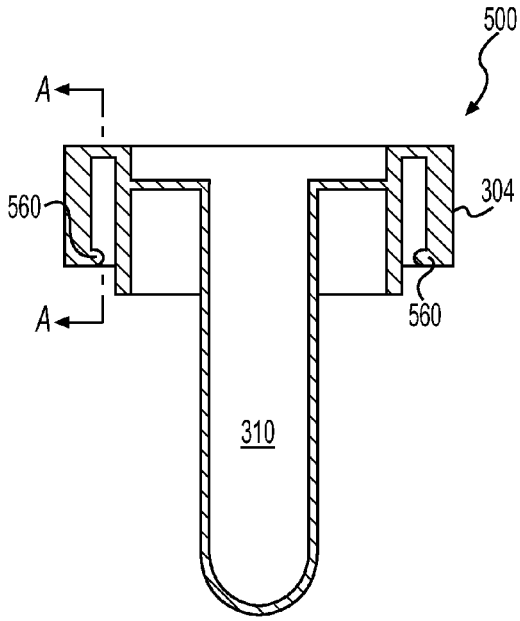
Figure 5C:
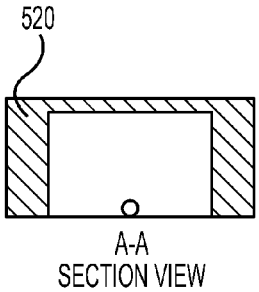
Figure 5D:
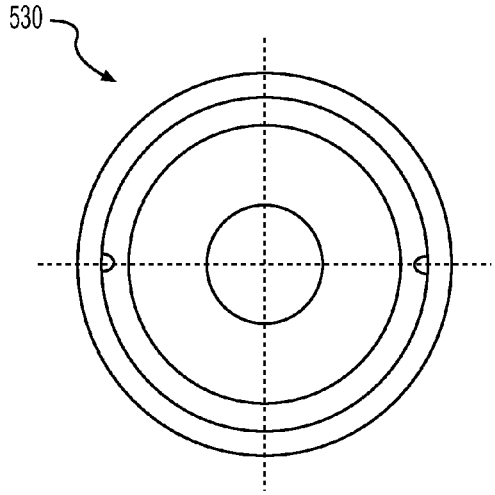

FIGS. 4A-4C depict further details of the second exemplary storage cap, defined for convenience here as a first "singular structure" 400, with emphasis on screw threads 460 noting that the end portions 462 of threads 460 may act to help lock structure 400 relative to structure 500 (of FIGS. 5A-5D) and/or to preclude the range of motion of plunger 310 relative to opening 330. Other locking and/or limiting mechanisms, such as detent structures built into structures 400 and or 500, may also be used separately or together with the exemplary thread shape of FIGS. 5A-5C.

Figure 6:
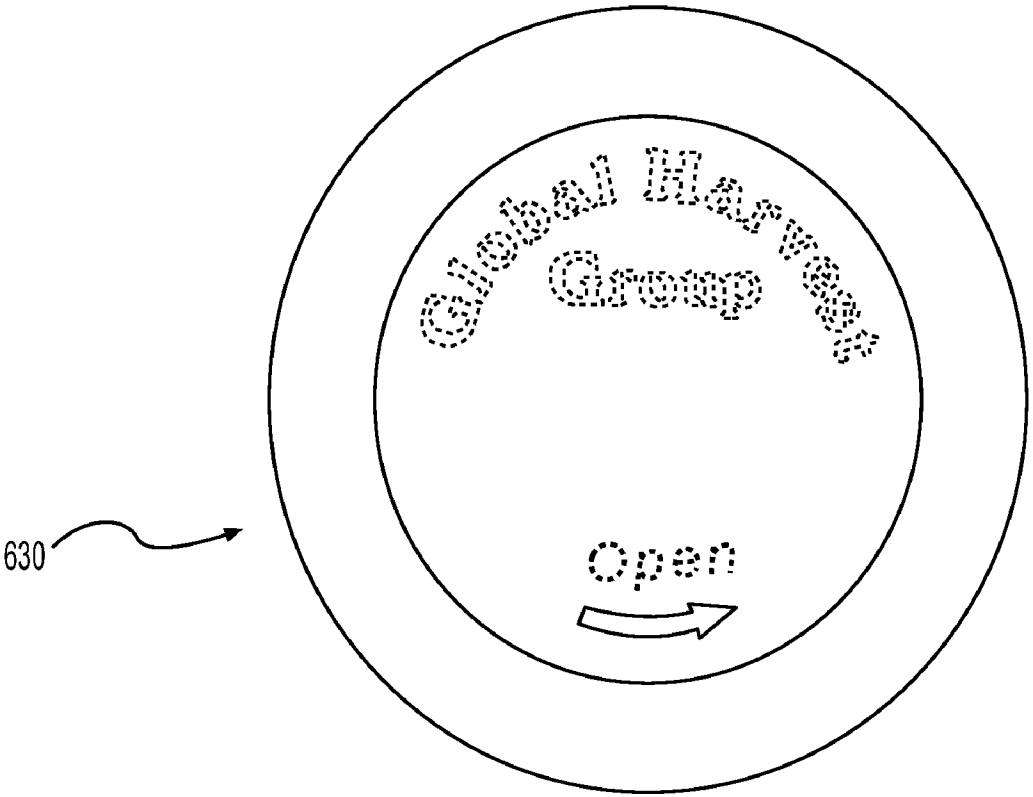
FIG. 6 depicts yet more details of the second exemplary storage cap.

FIGS. 5A-5D depict still further details of the second exemplary storage cap defined for convenience here as a the second "singular structure" 500, with emphasis on screw threads 560 usable with threads 460 of FIGS. 4A-4C. Cross-sectional view 520 and top view 530 are also added for better clarity. FIG. 6 depicts yet more details of the second exemplary storage cap, in particular, a "marking cap" 630 having engraved or integral product identification, advertising information and/or instructions embedded thereon.

Figure 7B:
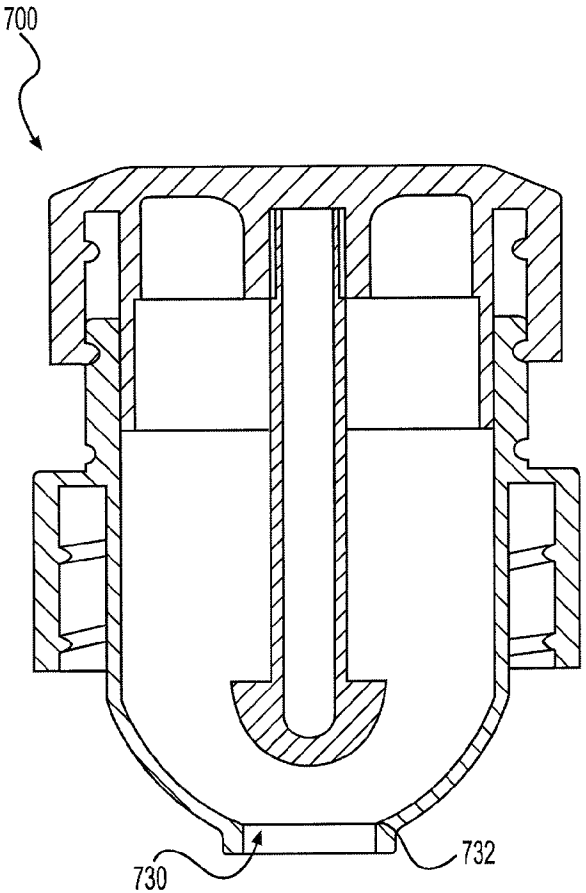
FIGS. 7A and 7B depict details of a third exemplary storage cap.
Figure 7A:
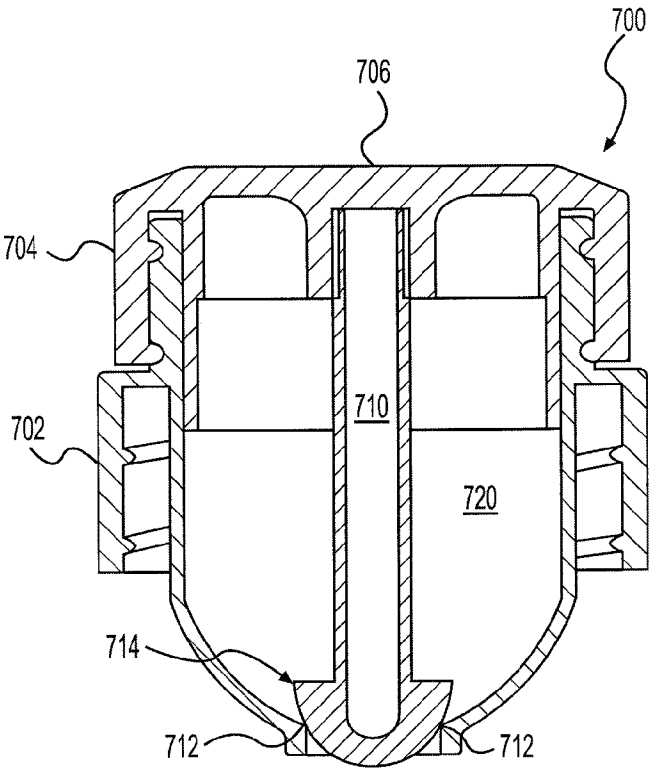
Figure 8:
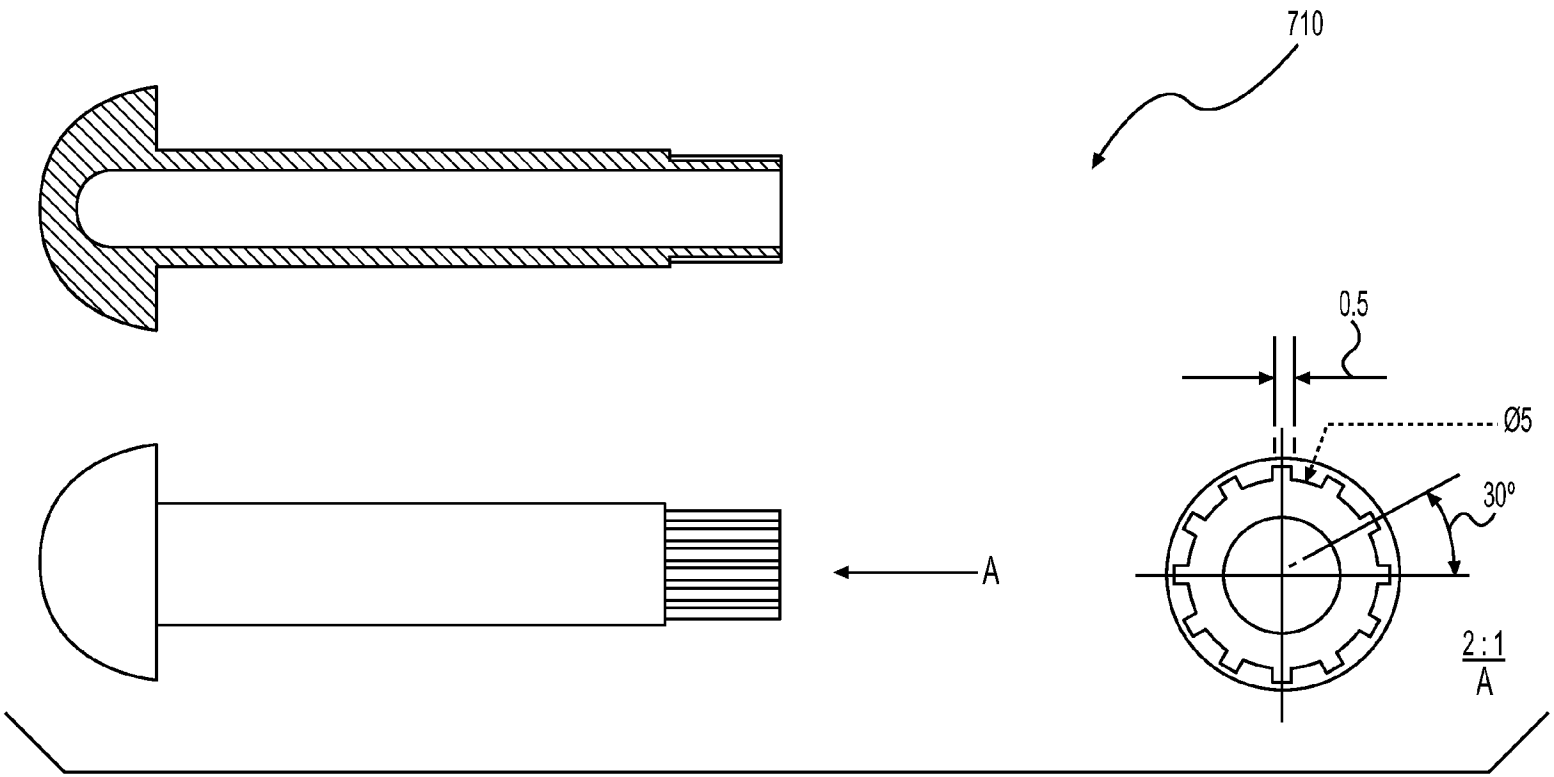
FIG. 8 depicts yet more details of the third exemplary storage cap.

FIGS. 7A and 7B depict details of a third exemplary storage cap 700 having elements 702, 704, 706, 710, 712, 714, 720, 730 and 732, which are essentially identical to elements 302, 304, 306, 310, 312, 314, 320, 330 and 332 of FIGS. 3A-3B, respectively, with the exception that plunger 710 is modified so as to have a dome 714 with a radius much larger as compared to the radius of the vertical element connecting dome 714 and top 706. An advantage of this configuration is that it allows for a greater volume of the storage chamber 720, with a possible disadvantage of increased complexity of manufacture as the plunger 710 may not be integral with elements 704 and/or 706. FIG. 8 depicts yet more details of the plunger 710 for the third exemplary storage cap 700.

Figure 9B:
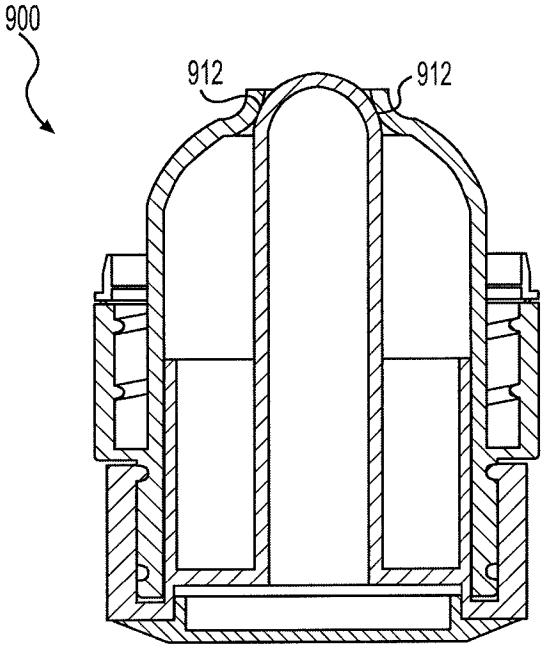
FIGS. 9A and 9B depict details of a fourth exemplary storage cap.
Figure 9A:
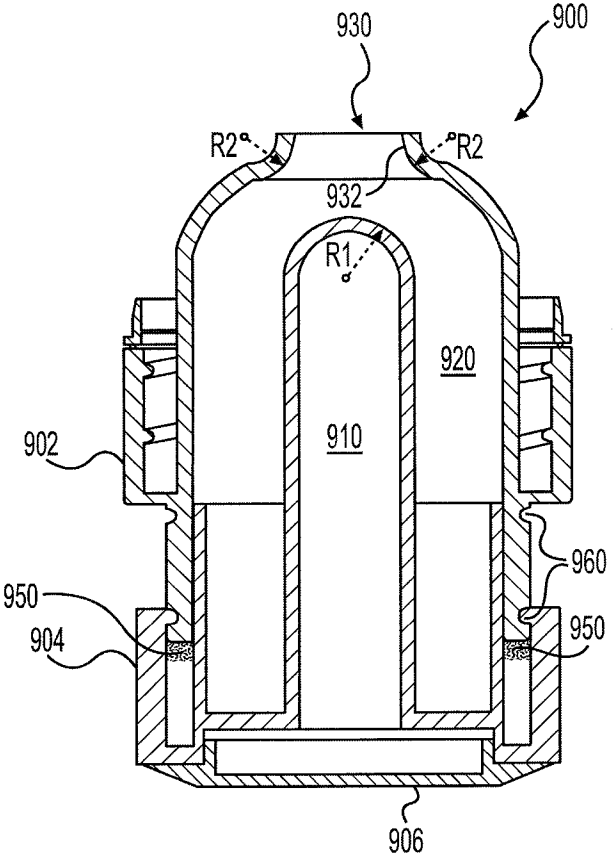

FIGS. 9A and 9B depict details of a fourth exemplary storage cap 900. As shown in FIG. 9, storage cap 900 includes elements 902, 904, 906, 910, 912, 920, 930 and 932 that are generally identical to respective elements 302, 304, 306, 310, 312, 320, 330 and 332 of FIGS. 3A-3B but with some notable differences. For example, edge 332 of FIGS. 3A-3B is replaced with a more rounded convex surface 932 (convex relative to the storage chamber 920 and plunger 910), which may have an advantages in manufacturing tolerances, use of plastic materials and reliability. Also, an optional gasket 950 between the two singular structures may be added to improve isolation of any stored substances in chamber 920 with the outside world. In addition, thread 940 received grip 904 to facilitate movement thereof.

Continuing, another advantage besides simplicity of manufacturing and reliability of the examples of FIGS. 3A-9B is the relative ease of filling and sealing the devices as compared to other storage caps. For example, when device dimensions are made to comply with standard consumer tops for various sports known drinks, suppliers can use the example tops of FIGS. 3A-9B with little or no retooling and/or use off-the-shelf assembly line techniques and devices. Accordingly, costs can be substantially reduced.

Figure 10:
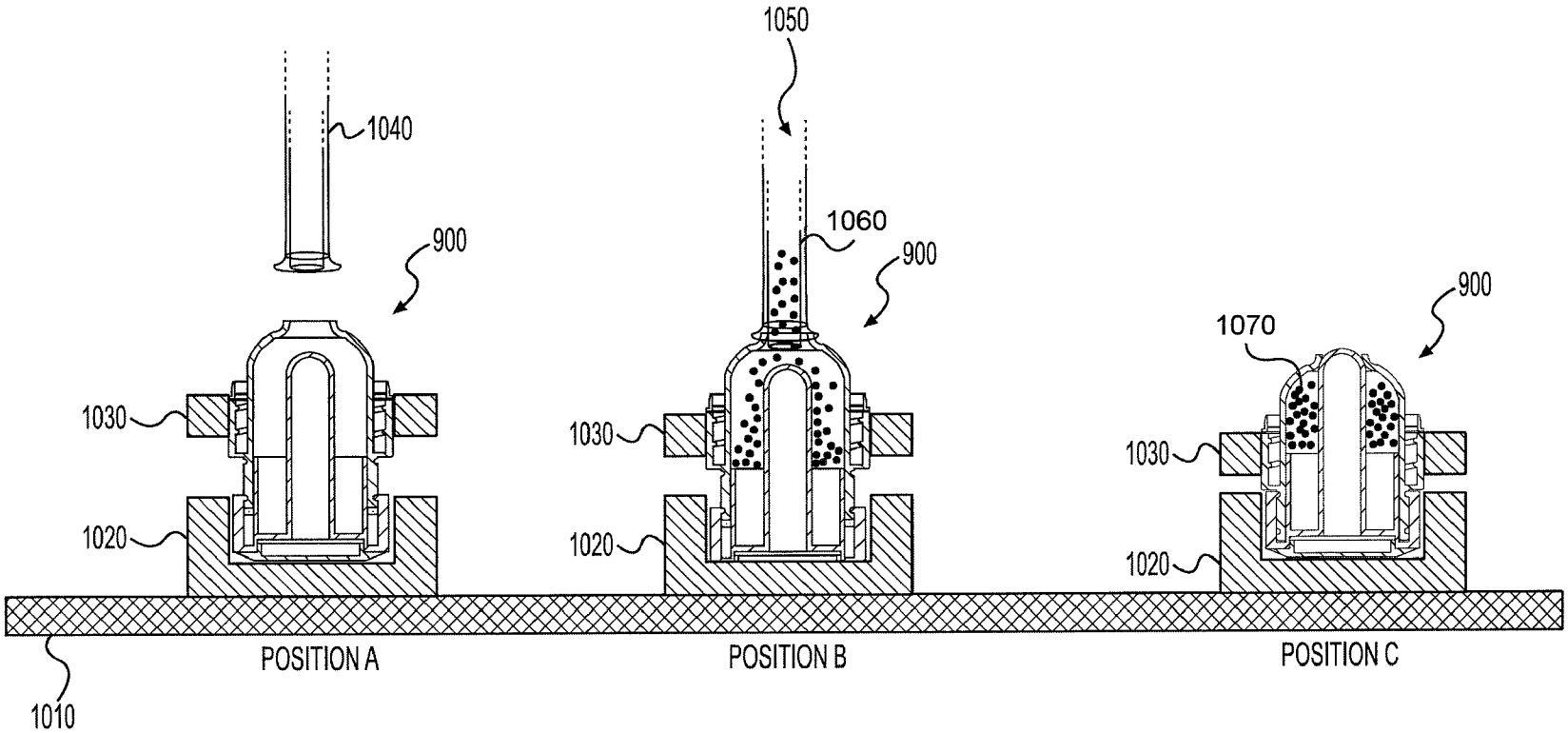
FIG. 10 depicts a filling process for any of the tops of FIGS. 2A-9B.

FIG. 10 depicts a filling process for any of the tops of FIGS. 3A-9B. As shown in FIG. 10, a conveyer belt 1010 having three positions A, B and C (provided for reference), as well as a first gripping element 1020, a second gripping element 1030 and a supply tube 1040.

In operation, an exemplary storage cap 900 can be placed within grips 1020 and 1030 at Position A of conveyer belt 1010, as well as placed under supply tube 1040. Note that storage cap 900 is not sealed at this position.

Next, at Position B, supply tube 1040 is lowered to make contact with the annular opening of storage cap 900 such that a flange or other sealing element (explained further below) can effectively seal the storage chamber of cap 900 relative to the outside of storage cap 900. Then, a substance 1070 can be injected into the storage chamber of storage cap 900 while displaced air from the storage chamber is vented. Upon filling the storage chamber, storage cap 900 is brought to position C where grips 1020 and 1030 can be made to rotate/twist relative to one another and thus cause the storage cap 900 to be sealed to the outside world as the two singular structures discussed above rotate/twist relative to one another causing the convex surfaces of the internal plunger and annular opening to meet.

It should be appreciated that, for the example of FIG. 10 the term "position" is depicted in terms of relative position. However, for may be thought of in spatial terms or alternately may be thought of in terms of manufacturing steps. For example, the steps depicted in Positions A, B and C may all occur at a single location depending on the particular manufacturing equipment used. Also, the term "position" may encompass more that a point in space but may alternately encompass a space or distance. For example, the filling process of Position B may take place as storage cap 900 moves continuously along conveyer belt 1010 over a distance of one meter.

Figure 11:
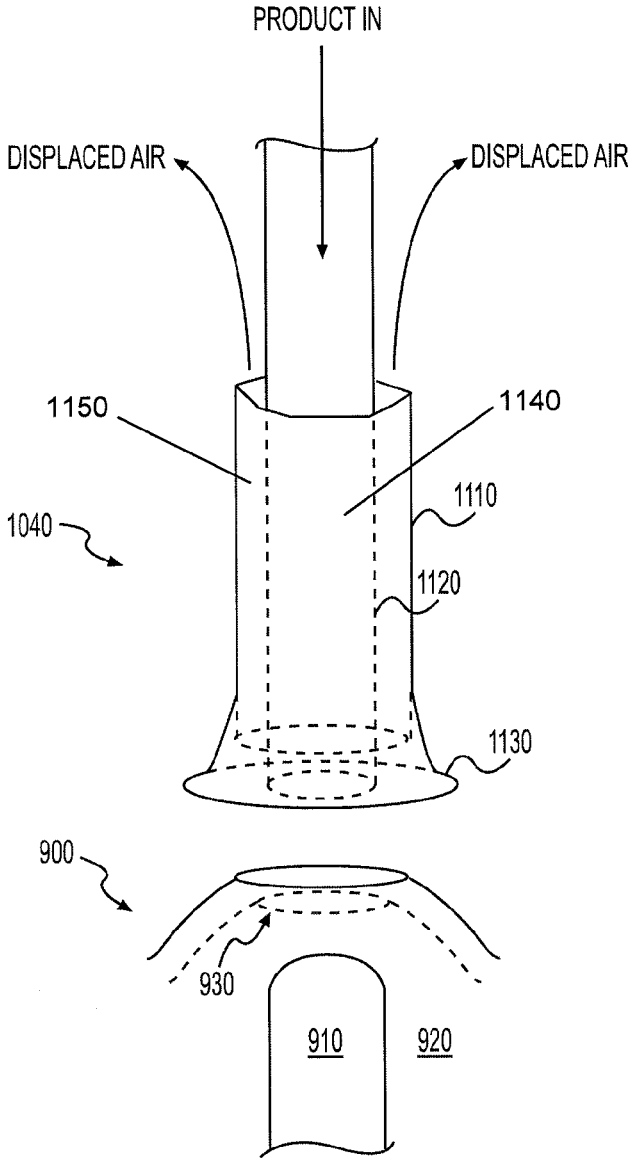
FIG. 11 depicts further details of the supply nozzle of FIG. 10.

FIG. 11 depicts further details of the supply tube 1040 of FIG. 10. As shown in FIG. 11, the exemplary supply tube 1040 includes an outer wall 1110 and an inner wall 1120 defining a supply passage 1140 and a displaced-air passage 1150. A flange 1130 is also included to seal the opening 930 of storage cap 900 from the outside world while a product is supplied to storage chamber 920 via supply passage 1140 and displaced air is vented via the displaced-air passage 1150.

Note that in alternate embodiments, the supply passage 1140 and displaced-air passage 1150 can take a variety of different physical configurations. For example, the particular functions of passages 1060 and 1050 may be reversed, passages 1140 and 1150 may be formed using tubes adjacent to one another and/or multiple tubes may be used to replace single tubes for either or both passages 1140 and 1150.

Looking at the plunger 910 in FIG. 11, it is to be appreciated that its domed-shaped end has another advantage (besides creating an effective seal) in that the domed-end facilitates the process of filling storage space 920 in that any powder or liquid dropped through passage 1140 can smoothly flow down and around the dome with little likelihood of any substantial amount of deposited product might stick to or otherwise be trapped at a critical location, such as that point of plunger 910 that would make contact with annular opening 930 to form a seal.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

It will be understood that many additional changes in the details, materials, steps and arrangement of parts, which have been herein described and illustrated to explain the nature of the invention, may be made by those skilled in the art within the principal and scope of the invention as expressed in the appended claims.

What is claimed is:

1. A storage cap for use with a container, comprising:

a first structure having a first wall at least partially defining an inner storage chamber operable for storing a first substance, the first wall also defining a first annular opening having a first annular convex surface facing toward the storage chamber and a diameter; and a second structure coupled to the first structure, the second structure including plunger element located within the storage chamber having a domed-end with a convex surface facing to the annular opening, the domed-end having a radius greater than one-half of the diameter of the first opening;

wherein the second structure is configured such that the domed end is moveable to make and break contact with the annular opening, and wherein when the domed end is in contact with the first annular convex surface, a seal is formed between two convex surfaces along an annular path to seal the storage chamber.

2. The storage cap of claim 1, wherein the first structure also includes a structure operable to enable the storage cap to be fastened at an opening of a container such that the first opening is sealed within the container, wherein the structure is a first threaded twist-top structure operable to enable the storage cap to be fastened to the container via a twisting action relative to the container.

3. The storage cap of claim 1, wherein the first structure is made from a single piece of plastic, and wherein the second structure is also made from a single piece of plastic.

4. The storage cap of claim 1, wherein the radius of the domed-end R1 is greater than the radius of the first annular convex surface R2.

5. The storage cap of claim 4, wherein the first annular convex surface is essentially a corner compared to the radius of the domed-end.

6. The storage cap of claim 5, wherein the radius of the domed-end R1 has a proportion to the radius of the first annular convex surface R2 of a range: $R2/10 \leqq R1 \leqq 10 \cdot R2$.

7. The storage cap of claim 6, wherein the radius of the domed-end R1 has a proportion to the radius of the first annular convex surface R2 of a range: $R2/3 \leqq R1 \leqq 3 \cdot R2$.

8. The storage cap of claim 7, wherein the radius of the domed-end R1 has a proportion to the radius of the first annular convex surface R2 of a range: $R2/1.5 \leqq R1 \leqq 1.5 \cdot R2$.

9. The storage cap of claim 1, wherein the second structure is coupled to the first structure via a threaded structure.

10. The storage cap of claim 9, wherein the second structure is coupled to the first structure via a second threaded twist-top structure such that twisting a grip on the second structure relative to the first structure causes the domed-end to move closer or farther away from the annular opening.

11. The storage cap of claim 10, wherein the second threaded twist-top structure includes at least one locking structure to hold the second structure at a first secure angle relative to the second structure.

12. The storage cap of claim 10, further comprising a gasket between the first structure and the second structure operable to improve the seal of the storage chamber.

13. The storage cap of claim 1, wherein:

the first structure also includes a first threaded twist-top structure operable to enable the storage cap to be fastened to the container via a twisting action relative to the container; and the second structure is coupled to the first structure via a second threaded twist-top structure such that twisting a grip on the second structure relative to the first structure causes the domed-end to move closer or farther away from the annular opening.

14. The storage cap of claim 13, wherein:

the second threaded twist-top structure includes at least one locking structure to hold the second structure at a first secure angle relative to the second structure; and a gasket exists between the first structure and the second structure operable to improve the seal of the storage chamber.

15. A method for filling a storage cap for use with a container, wherein the storage cap includes a first structure having a first wall at least partially defining an inner storage chamber operable for storing a first substance, the first wall also defining a first annular opening, and a second structure coupled to the first structure, the second structure including plunger element located within the storage chamber having a domed-end with a convex surface facing to the annular opening, and wherein the second structure is configured such that the domed end is moveable to make and break contact with the annular opening via a twisting motion of a grip on the second structure relative to the first structure, the method comprising:

placing a first tube having a product-depositing passage, a displaced-air passage and a flange over the annular opening such that the flange substantially seals respective ends of the product-depositing passage and the displaced-air passage to the storage chamber;

using the product-depositing passage to deposit a first substance within the storage chamber while the displaced-air passage removes displaced air from the storage chamber; and twisting the first structure relative to the second structure to cause the domed end to form a seal with the annular opening thus sealing the first substance within the storage chamber.

16. The method for filling a storage cap of claim 15, further comprising twisting the storage cap onto a container such that the first opening is sealed within the container.

17. An automated assembly line, comprising:

a conveyer line operable to convey a plurality of storage caps for use with a container, wherein each storage cap includes a first structure having a first wall at least partially defining an inner storage chamber operable for storing a first substance, the first wall also defining a first annular opening, and a second structure coupled to the first structure, the second structure including plunger element located within the storage chamber having a domed-end with a convex surface facing to the annular opening, and wherein the second structure is configured such that the domed end is moveable to make and break contact with the annular opening via a twisting motion of a grip on the second structure relative to the first structure;

a first station in the conveyer line with a first tube having a product-depositing passage, a displaced-air passage and a flange operable to be placed over the annular opening of each storage cap such that the flange substantially seals respective ends of the product-depositing passage and the displaced-air passage to the respective storage chamber, and wherein the product-depositing passage is then operable to deposit a first substance within the storage chamber while the displaced-air passage is operable to remove displaced air from the storage chamber; and a twisting mechanism on the conveyer belt operable to twist the first structure relative to the second structure to cause the domed end to form a seal with the annular opening thus sealing the first substance within the storage chamber.

18. The automated assembly line of claim 17, further comprising twisting the storage cap onto a container such that the first opening is sealed within the container.

* * * * *